US011812536B2

(12) United States Patent
Hadoulias et al.

(10) Patent No.: US 11,812,536 B2
(45) Date of Patent: Nov. 7, 2023

(54) MAGNETIC INDUCTION FLUID HEATER

(71) Applicant: Inductive Engineering Technology, LLC, Cocoa Beach, FL (US)

(72) Inventors: Stamatios Hadoulias, Rockledge, FL (US); Jerome Guzman, Cocoa Beach, FL (US); John C. May, Cocoa Beach, FL (US); Christopher F. Vonderheide, Rockledge, FL (US)

(73) Assignee: Inductive Engineering Technology, LLC, Cocoa Beach, FL (US)

( * ) Notice: Subject to any disclaimer, the term of this patent is extended or adjusted under 35 U.S.C. 154(b) by 510 days.

(21) Appl. No.: 16/897,133

(22) Filed: Jun. 9, 2020

(65) Prior Publication Data

US 2020/0389947 A1 Dec. 10, 2020

Related U.S. Application Data

(60) Provisional application No. 62/859,599, filed on Jun. 10, 2019.

(51) Int. Cl.

| | |
|---|---|
| ***H05B 6/10*** | (2006.01) |
| ***H05B 6/36*** | (2006.01) |
| ***F24H 9/1818*** | (2022.01) |
| ***F24H 9/20*** | (2022.01) |
| ***H05B 6/06*** | (2006.01) |

(52) U.S. Cl.

CPC ..... *H05B 6/108* (2013.01); *F24H 9/1818* (2013.01); *F24H 9/2014* (2013.01); *H05B 6/06* (2013.01); *H05B 6/36* (2013.01); *F24H 2250/08* (2013.01)

(58) Field of Classification Search

CPC .. F24H 2250/08; F24H 9/1818; F24H 9/2014; H05B 6/06; H05B 6/108; H05B 6/36

See application file for complete search history.

(56) References Cited

U.S. PATENT DOCUMENTS

| | | | |
|---|---|---|---|
| 3,651,240 | A | 3/1972 | Kirkpatrick |
| 5,131,461 | A | 7/1992 | Szucs |

(Continued)

FOREIGN PATENT DOCUMENTS

| | | |
|---|---|---|
| WO | WO 2005022955 | 3/2005 |
| WO | WO 2007091749 | 8/2007 |

OTHER PUBLICATIONS

PCT International Search Report and Written Opinion issued in PCT/US2016/019927, dated May 11, 2016, 8 pages.

*Primary Examiner* — Dana Ross
*Assistant Examiner* — Joe E Mills, Jr.
(74) *Attorney, Agent, or Firm* — Knobbe, Martens, Olson & Bear, LLP

(57) ABSTRACT

A magnetic induction heating system is described. The heating system includes a receptacle and a substrate positioned within the receptacle. The substrate includes ferrous material and forms a cavity that can be filled with fluid, such as water or other liquid. An induction coil at least partially encompasses the substrate. A controller provides alternating current to the induction coil. The alternating current in the induction coil induces an electromagnetic field that creates heat in the substrate. The heat in the substrate heats the fluid. The heating system can further include valves on either end of the substrate that enable fluid to move between the cavity and a chamber that is formed by the receptacle.

19 Claims, 4 Drawing Sheets

(56) References Cited

U.S. PATENT DOCUMENTS

| | | | | |
|---|---|---|---|---|
| 5,841,244 | A | 11/1998 | Hamilton et al. | |
| 9,544,945 | B2 | 1/2017 | Hadoulias et al. | |
| 2004/0060927 | A1 | 4/2004 | Kim et al. | |
| 2004/0182855 | A1 | 9/2004 | Centanni | |
| 2004/0240182 | A1 | 12/2004 | Shah | |
| 2005/0006380 | A1 | 1/2005 | Kagan | |
| 2005/0095168 | A1 | 5/2005 | Centanni | |
| 2006/0157479 | A1 | 7/2006 | Claesson et al. | |
| 2008/0011336 | A1* | 1/2008 | Hamaguchi | H05B 6/108 134/105 |
| 2008/0223852 | A1 | 9/2008 | Bassill et al. | |
| 2009/0092384 | A1 | 4/2009 | Luo et al. | |
| 2009/0255142 | A1 | 10/2009 | Brown | |
| 2010/0163549 | A1 | 7/2010 | Gagas et al. | |
| 2011/0215089 | A1 | 9/2011 | Garza | |
| 2016/0037586 | A1* | 2/2016 | Armstrong | C23C 16/46 219/630 |
| 2017/0127480 | A1 | 5/2017 | Hadoulias et al. | |
| 2018/0180367 | A1* | 6/2018 | Folk | H05B 6/36 |

* cited by examiner

MAGNETIC INDUCTION FLUID HEATER

RELATED APPLICATIONS

The present application claim priority to U.S. App. No. 62/859,599, which is incorporated by reference herein in its entirety.

SUMMARY

Systems and methods are described in which magnetic induction heating can be utilized to efficiently heat fluid, such as liquid fluid, for a multitude of uses such as but not limited to instant-on hot water, point-of-use hot water systems, central water heaters, tank recirculation systems for retrofitting existing in place water heating elements with significant energy savings compared to conventional and currently used technologies common in the general market place, or other fluid heating systems. In preferred embodiments, magnetic induction is used as a modified heat producing component which can eliminate the problems and safety hazards associated with limited life and extremely low efficiency of existing electrical resistive means and/or petroleum ignited methods of heat generation.

In another aspect, the magnetic induction devices can provide the ability to create a magnetic field sufficient to accelerate at the molecular level, particles in a substrate to the point of producing extremely efficient heat. The efficiency of the heating occurring at the magnetically induced substrate level can reduce or eliminate the losses typically encountered through conventional means of heat through multiple substrate surfaces relying on conduction through varying material compositions. This precludes the coefficient of heat transfer losses through multiple substrate materials and this translates directly into more heat energy per given watt of energy.

According to another aspect, the particular design of the magnetic induction circuit board providing a radio frequency (RF) energy over conventional designs, the frequency of the RF energy emitted as a magnetic field into a substrate can be adjusted to address the specific requirements of various density and magnetic attraction in the substrate, resulting in the ability to "focus" the magnetic energy to reach maximum heat potential in various substrate configurations, thermal sinks and/or other combined magnetic induction and thermal conduction methods as necessary to produce the required heat capacity requirements for a According to another aspect, the magnetic induction heat source can heat a coil or series of coils whereby fluid flows from ambient temperature and is immediately heated to provide hot fluid supply for bathing or other hot fluid needs directly where desired. Significant fluid conservation is also a benefit of heating only the fluid used without piping hot fluid from a single source throughout a typical plumbing distribution system. Large quantities of fluid for such use as a pool heater, radiator heating system or other types of hot fluid derived heat energy powered systems could be designed or converted to a magnetic induction heat source.

DETAILED DESCRIPTION

Heating fluid, such as water in a residential water heater (or other liquid), can be very inefficient from an energy standpoint. The inefficiency can increase energy costs and pollution. Further, water heaters typically represent the second highest use of energy next to HVAC systems. Magnetic induction, whereby magnetic fields and their associated lines of flux have been converted into a useable source of heat energy, can be utilized in a variety of applications, including heating fluids, like water. Magnetic induction heating can be based on resonant tank circuits, where capacitive and inductive reactance create resonant frequencies of A/C magnetic fields and/or eddy currents, electrical currents, magnetic flux densities, whereby the molecular structure of magnetic, diamagnetic, graphite or metal alloys and/or ferrous metals are directly agitated to the point where immediate heating from accelerated atomic particle friction generates heat to the substrate, directly within the magnetic field.

Accordingly, magnetic induction can be utilized as an efficient, cost effective and energy savings method of replacing antiquated and unsafe methods of heat producing sources in existing fluid heating appliances and devices. Systems and methods are described herein to enable effective control of the magnetic field generated electronically, to maximize the effect on the heated substrate.

Figure 1A:
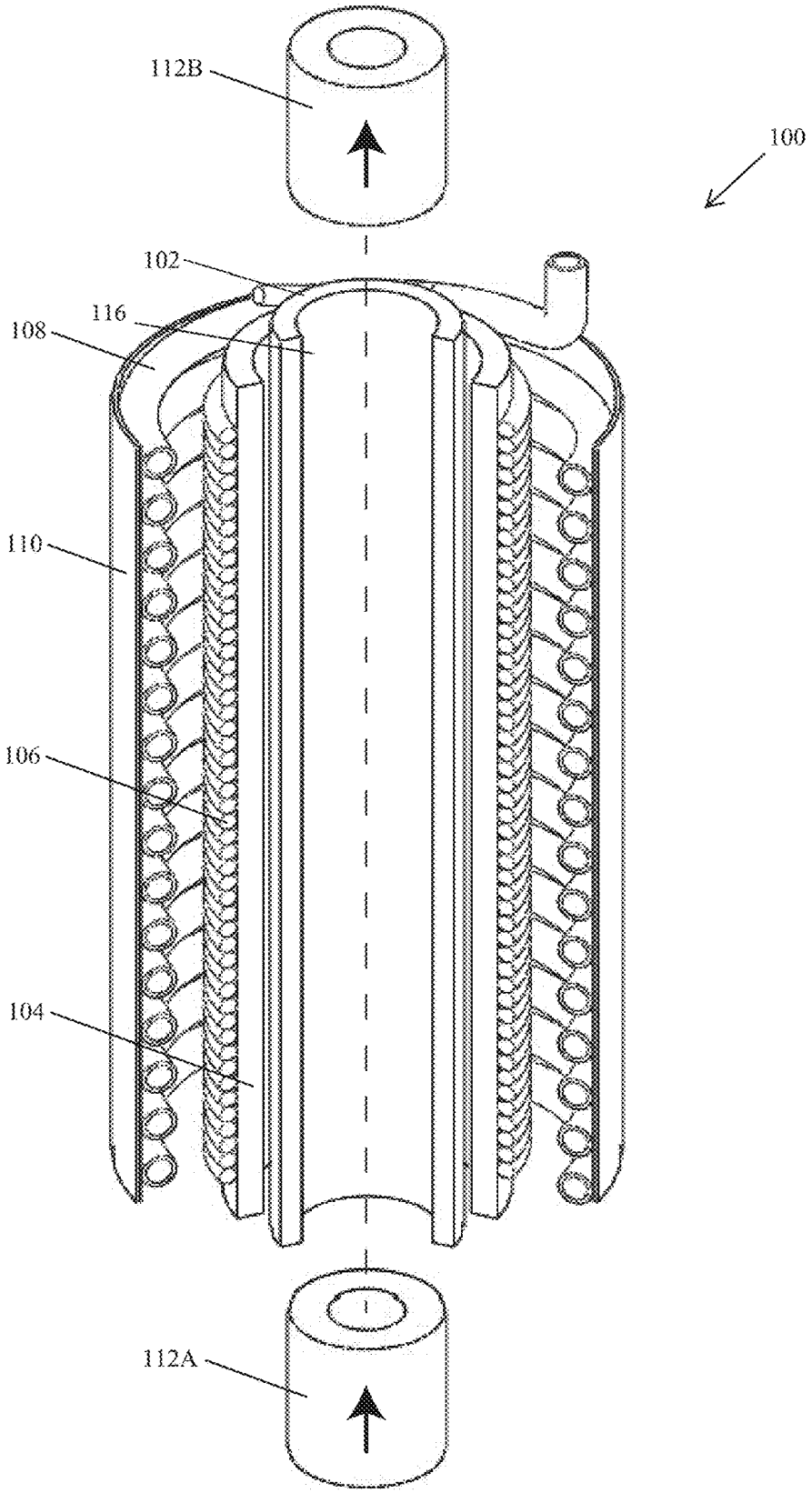
FIG. 1A is a cross-sectional diagram illustrating an embodiment of a fluid heating system using magnetic induction.
Figure 1B:
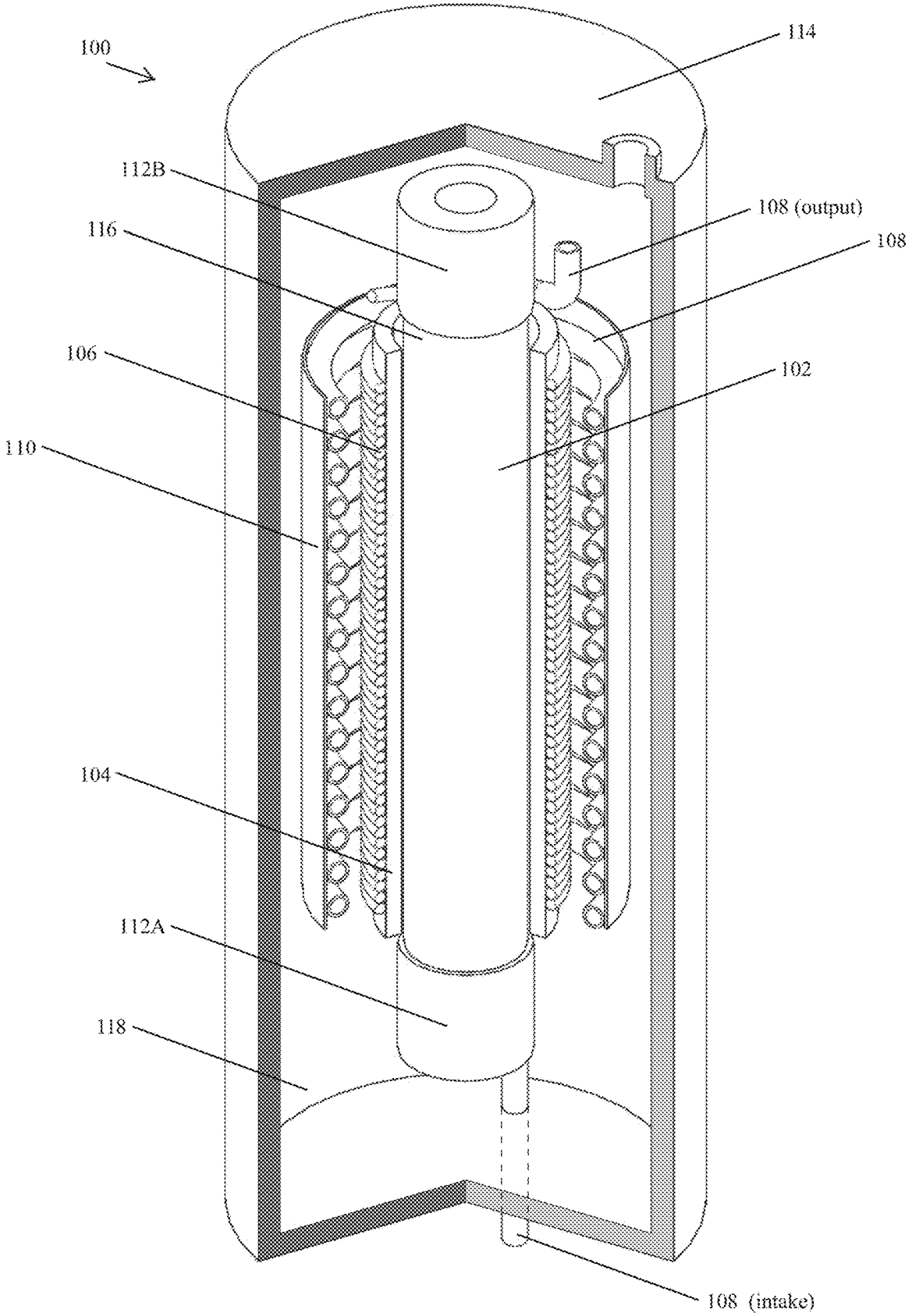
FIG. 1B is a partial cutaway diagram showing an embodiment of the fluid heating system.

FIG. 1A is a cross-sectional diagram illustrating an embodiment of a fluid heating system 100 using magnetic induction. FIG. 1B is a partial cutaway diagram showing an embodiment of the fluid heating system 100. In certain cases, the system uses magnetic induction where capacitive and inductive reactance create resonant frequencies of magnetic fields and/or eddy currents, electrical currents, magnetic flux densities, and combinations thereof to directly agitate the molecular structure of magnetic or ferrous metals to the point where immediate heating from accelerated atomic particle friction occurs to the metal substrate directly within the magnetic field.

The system is configured to create a magnetic field sufficient to accelerate at the molecular level, particles in one or more thermal conductors to the point of producing efficient heat. The efficiency of the heating occurs at the magnetically induced substrate level eliminating or reducing the losses typically encountered through conventional heating devices employing multiple substrate surfaces and conduction through various material compositions.

In the illustrated embodiment of FIGS. 1A and 1B, certain components of the system 100 are shown, including a tube 102, thermoplastic tube 104, induction coil 106, rolled tube 108, sleeve 110, check valves 112A, 112B (collectively and generically referred to as check valve(s) 112), and a receptacle 114 (shown in FIG. 1B).

It will be understood that the system 100 can be configured to include fewer or more components. For example, in some embodiments, the mechanical components of the system 100 may include only the tube 102, thermoplastic tube 104, induction coil 106, and receptacle 114. In some such embodiments, the system 100 can heat fluid (e.g., liquid fluid) in contact with the tube 102 (interior and exterior to) and that fluid can circulate throughout the receptacle 114 and heat it. In some cases, the mechanical components of the system 100 may only include the induction coil 106, receptacle 114, and any one or any combination of the tube 102, rolled tube 108, and/or the sleeve 110. In some such embodiments, the induction coil 106 can be used to generate heat in and around the tube 102, rolled tube 108, and/or the sleeve 110, which can be transferred to a fluid in the receptacle 114.

In certain embodiments, the system 100 may not include the check valves 112. In some such embodiments fluid (e.g., liquid fluid) may freely flow within the tube 102, be heated, and then circulate with (and heat) other fluid in the receptacle 114. Accordingly, it will be understood that the system 100 can be configured in a myriad of ways.

Although some of the components are described as shaped in a helical pattern or illustrated with a cylindrical shape or a circular or ellipsoid horizontal cross-sectional shape (where horizontal is with reference to the orientation of the component as illustrated in FIG. 1A, 1B), it will be understood that other geometries or shapes can be used for the components of the heating system 100 including, but not limited to square, conical, square, cube rectangular, rectangular prism, etc. Thus, the tubes (e.g., tube 102, thermoplastic tube 104, rolled tube 108, sleeve 110, etc.) described herein can have a cross-section that is circular, ellipsoid, rectangular, square, triangular, etc. In some cases, the components can all be the same shape and/or have the same horizontal cross-sectional shape. In certain embodiments, the components may have different horizontal cross-sectional shapes.

The tube 102 can be can be made of a ferrous metal (including alloys), such as stainless steel, or other material that generates heat in response to an electromagnetic field. In this way, as an AC current is applied to the induction coil 106 and an electromagnetic field is generated, the tube 102 can generate heat. In some such embodiments, the tube 102 can also be referred to herein as a heating tube, heatable tube, heating substrate or heatable substrate.

The tube 102 can be shaped to form a chamber or cavity 116 (also referred to herein as a heating cavity or chamber, or inner chamber) that can hold fluid, such as a liquid fluid. The heat generated in the tube 102 by the induction coil 106 can be transferred to the fluid in the cavity 116. In some cases, the exterior surface of the tube 102 can be in contact with fluid. In some such embodiments, the heat generated by the tube 102 can be transferred to the fluid that is in contact with the exterior surface of the tube 102. As the fluid is heated it can increase in pressure and/or begin to move. Depending on the configuration of the system 100, as the heated fluid moves or increases in pressure, it can be replaced with fluid that is cooler. For example, with reference to the illustrated example, cooler fluid above and/or below the openings of the tube 102 can move in an out of the cavity 116. As such, heated fluid within the cavity 116 can in turn heat other fluid in the receptacle 114. In this way, the system 100 can heat the fluid within the receptacle 114. In addition, the tube 102 can heat fluid on its exterior. For example, the tube 102 can heat fluid that is located between its exterior surface and the interior surface of the thermoplastic tube 104.

In certain embodiments, the tube 102 can be made of a non-ferrous material (e.g., copper, tin, aluminum, or a non-ferrous alloy). In some such embodiments, the tube 102 may not be used to heat fluid within the cavity 116. Further, in some such embodiments, other components of the system 100, such as, but not limited to, the rolled tube 108 and/or sleeve 110 may be used to heat fluid within the receptacle 114. In certain embodiments, the tube 102 can be made of an alloy that includes all ferrous materials, ferrous and non-ferrous materials, or all non-ferrous materials.

In the illustrated embodiment, the top and bottom of the tube 102 are open. However, it will be understood that the top and bottom of the tube 102 can be shaped and configured to be closed or partially closed. For example, the top and bottom of the tube 102 can be closed to allow for the flow of fluid and/or the check valves 112.

The thermoplastic tube 104 can be made of thermoplastic, ceramic, glass, or other material that can withstand high temperatures without melting and/or that does not conduct electricity and/or heat in an efficient manner. The thermoplastic tube 104 can encircle or encompass the tube 102 and serve as a mandrel for the induction coil 106. In some embodiments, the thermoplastic tube 104 can be in direct contact with the tube 102. In certain embodiments, a space can be present between the interior surface of the thermoplastic tube 104 and the exterior surface of the tube 102. In some such embodiments the space can be filled with liquid that is to be heated. In certain embodiments, the thermoplastic tube 104 may not completely encircle or encompass the tube 102. Rather, the thermoplastic tube 104 may substantially encompass the tube 102. For example, the thermoplastic tube 104 may be 5% or 10% open (e.g., if the cross-sectional shape of the thermoplastic tube 104 is a circle with a circumference of $2\pi r$, then $\pi*r/8$ or $\pi*r/4$ of the circle may be missing).

In the illustrated embodiment, the top and bottom of the thermoplastic tube 104 are open. However, it will be understood that the thermoplastic tube 104 can be shaped and configured to be closed. For example, the thermoplastic tube 104 can be shaped and configured to encase and/or wholly enclose the tube 102, or encase the tube 102 except for one or two openings to allow for the passage of fluid and/or the check valves 112.

The induction coil 106 can be made of insulated wire, such as Litz wire, and can be used to generate heat in ferrous materials. For example, alternating current can be applied to the induction coil 106 to induce an electromagnetic field. The electromagnetic field can generate heat in surrounding ferrous materials, such as, but not limited to, the tube 102, rolled tube 108, and/or sleeve 110. In some embodiments, the induction coil 106 can be wound in a helical pattern and can encircle or enclose the high temperature thermoplastic tube 104. In some cases, the induction coil 106 can be positioned within the heating tube 102. In certain embodiments, the induction coil can be immersed in the fluid that is to be heated. In some such embodiments, the induction coil 106 can be covered in a waterproof material, such as silicone.

The rolled tube 108 can, similar to the tube 102, be made of a ferrous material or non-ferrous material. In embodiments, in which the rolled tube 108 is made of a ferrous material, like stainless steel, it can generate heat in response to an electromagnetic field being applied to it. In certain embodiments, the rolled tube 108 can be made of a non-ferrous material so as to not generate heat in response to an electromagnetic field.

In some embodiments, the rolled tube 108 can be wound in a helical fashion with an intake and output or an inlet and outlet. In the illustrated embodiments of FIGS. 1A and 1B, the intake is at the bottom of the figure and the output is at the top of the figure. In the illustrated embodiment, the inlet receives fluid from a source that is exterior to the receptacle 114. The fluid is directed along the path of the rolled tube 108 from the intake of the rolled tube 108 to the output. The fluid that exits the rolled tube 108 can fill up the receptacle 114.

In the illustrated embodiment of FIG. 1A, the rolled tube 108 encircles or encompasses at least a portion of the tube 102, thermoplastic tube 104, and the induction coil 106. However, it will be understood that the rolled tube 108 can be placed in a variety of positions. In certain embodiments, the rolled tube 108 can be placed within the tube 102, thermoplastic tube 104, and/or the induction coil 106, or otherwise proximate to the induction coil 106 (e.g., close enough to be within the electromagnetic field generated using the induction coil 106, where the size of the electromagnetic field is based on the size of the coil and the amount of current that is flowing through it). As such, in embodiments in which the rolled tube 108 includes ferrous material, it can generate heat, which can be transferred to the fluid inside the rolled tube 108 and exterior to the rolled tube 108.

During use, fluid can enter the rolled tube 108 and alternating current can be applied to the induction coil 106 to induce an electromagnetic field. The electromagnetic field can induce heat in the rolled tube 108 thereby heating the fluid within the rolled tube 108. As such, fluid coming out of the output of the rolled tube 108 can have a higher temperature than fluid at the input of the rolled tube 108. A controller can be used to control the current applied to the induction coil 106 thereby controlling the amount of heat provided to the fluid in the rolled tube 108. When a desired temperature of the fluid in the receptacle 114 is reached, the current applied to the induction coil 106 can be deactivated. In some embodiments, fluid in the rolled tube 108 can move more slowly and be heated more slowly than fluid in the tube 102.

In some embodiments, the system 100 may not include the tube 102 and/or the sleeve 110. In some such embodiments, the system 100 can heat fluid in the receptacle 114 using the rolled tube 108. In some such embodiments, the rolled tube 108 can heat fluid inside of it as it moves along the rolled tube 108 and heat fluid that is exterior to the rolled tube 108. Further, in some such embodiments, the interior of the rolled tube 108 can form the cavity 116.

The sleeve 110 can, similar to the tube 102 and rolled tube 108, be made of a ferrous material or non-ferrous material. In embodiments in which the sleeve 110 is made of a ferrous material it can generate heat from the application of an electromagnetic field. In some embodiments, the sleeve 110 can also be referred to as a tube 110, heating tube, heatable tube, heating substrate or heatable substrate. As such, fluid surrounding the sleeve 110 can be heated. In some embodiments, the tube 102, rolled tube 108, and/or sleeve 110 can be made of the same material or different materials. In this way, the sleeve 110, rolled tube 108, and/or tube 102 can be configured to generate varying levels of heat based on the electromagnetic field applied to them.

In certain embodiments, the tube 102, rolled tube 108, and sleeve 110 are made of ferrous material. In this way the system 100 can increase the amount of material that generates heat from the application of current applied to the induction coil 106. By increasing the amount of ferrous material within the electromagnetic field generated by the induction coil 106, the system 100 can increase efficiency of energy conversion from electricity to heat. In some such embodiments, the tube 102, rolled tube 108, and sleeve 110 can heat any fluid with which they are in contact.

In some embodiments, the sleeve 110 can encircle or encompass all or a portion of, any one or any combination of the tube 102, thermoplastic tube 104, induction coil 106, rolled tube 108, and/or high temperature and check valves 112. Further, it will be understood that the sleeve 110 may not completely encircle or encompass the aforementioned components. Rather, the sleeve 110 may substantially encompass any one or any combination of the aforementioned components. For example, the sleeve 110 may be 5% or 10% open (e.g., if the cross-sectional shape of the sleeve 110 is a circle with a circumference of $2\pi r$, then $\pi^*r/8$ or $\pi^*r/4$ of the circle may be missing).

It will be understood that the sleeve 110 can be placed in a variety of positions. In certain embodiments, the sleeve 110 can be encircled by the rolled tube 108, induction coil 106, thermoplastic tube 104, and/or tube 102. In some embodiments, the sleeve 110 may not be encircled by or encircle the aforementioned components, but may otherwise be proximate to the induction coil 106 (e.g., close enough to be within the electromagnetic field generated using the induction coil 106). As such, in embodiments in which the sleeve 110 includes ferrous material, it can generate heat, which can be transferred to the fluid interior to and exterior to the sleeve 110.

In certain embodiments, the length or height of the tube 102, thermoplastic tube 104, induction coil 106, rolled tube 108, and/or sleeve 110 can be approximately equal. In some such embodiments, the valves 112 may extend above and below the sleeve 110. In some embodiments, the sleeve 110 can be longer or taller than the tube 102, thermoplastic tube 104, induction coil 106, and/or rolled tube 108, so that it can encompass the valves 112.

In some embodiments, the shape of the sleeve 110 can be based on the shape of the components that it encompasses. For example, if the horizontal cross section of the tube 102, thermoplastic tube 104, rolled tube 108, and/or induction coil 106 are square shaped or rectangular shaped, the horizontal cross section of the sleeve 110 can be square shaped or rectangular shaped, respectively.

In the illustrated embodiment, the top and bottom of the sleeve 110 are open. However, it will be understood that the sleeve 110 can be shaped and configured to be closed. For example, the sleeve 110 can be shaped and configured to encase and/or wholly enclose the tube 102, induction coil 106, rolled tube 108, and thermoplastic tube 104, or encase the aforementioned components except for one or two openings for the end of the rolled tube 108, induction coil 106, and/or check valves 112.

In some embodiments, the system 100 may not include the tube 102 and/or the rolled tube 108. In some such embodiments, the system 100 can heat fluid in the receptacle 114 using the sleeve 110. In some such embodiments, the sleeve 110 can heat fluid that is exterior to the sleeve 110 and fluid that is interior to the sleeve 110. Further, on some such embodiments, the interior of the sleeve 110 can form the cavity 116.

The check valves 112 can be made of ferrous, non-ferrous materials, or any combination of ferrous and non-ferrous materials, and can be used to enable fluid to move inside and out of the tube 102. In some embodiments, the check valves 112 can be pressure valves with a pressure threshold. When the pressure threshold is satisfied, the check valves 112 can open. When the pressure threshold is not satisfied, the check valves 112 can close.

In some embodiments, the check valves 112 can be coupled to the tube 102 and/or the thermoplastic tube 104 and can be used to allow fluid to enter and exit different chambers of the system 100, such as cavity 116 and chamber 118. In certain embodiments, the check valves 112 can be coupled to the tube 102 using an adhesive or fastener. In some cases, the tube 102 can be threaded at either end and the check valves 112 can be twisted or screwed on to the tube 102.

In some embodiments, the cavity 116 may be located within and formed by the tube 102 and/or thermoplastic tube 104. For example, the cavity 116 may be defined by the interior surface of the tube 102 and/or the interior surface of the thermoplastic tube 104. In some embodiments, the cavity 116 can further be defined by the valves 112.

In certain embodiments, the outer chamber 118 (also referred to herein as a heating cavity or chamber) may be located exterior to the tube 102 and/or thermoplastic tube 104. In some embodiments, the outer chamber can correspond to the interior space of the receptacle 114. In some such embodiments, the outer chamber 118 does not include the cavity 116. In some embodiments fluid within the inner chamber 116 is isolated from the fluid within the outer chamber 118. In some such cases, the check valves 112 can be used to enable fluid to flow between the two chambers 116, 118. In some such cases, the valves 112 may be configured to allow for a unidirectional fluid path. For example, when the upper valve 112 is opened, fluid may exit the inner chamber 116 and enter the outer chamber 118 (or vice versa). When the lower valve is opened, fluid may exit the outer chamber 118 and enter the inner chamber 116 (or vice versa).

In some embodiments, the valves 112 can be pressure-operated or open and close based on pressure. As such, when the pressure on a pressure sensitive side satisfies a pressure threshold, the valves 112 can open. When the pressure on the pressure sensitive side does not satisfy the pressure threshold the valves 112 can close. In some embodiments, the pressure threshold can be based on an absolute pressure. In certain embodiments, the pressure threshold can be based on a differential pressure (e.g., the difference in pressure between the pressure sensitive side and the other side of the valve 112).

In certain embodiments, the intake valve 112A can be oriented such that when the pressure of the fluid (e.g., liquid fluid like water) on the outside of the cavity 116 satisfies a pressure threshold (e.g., exceeds the pressure of the fluid within the cavity 116 by a threshold amount), the intake valve 112A can open allowing fluid to enter the cavity 116. This may occur, for example, when there is no liquid fluid in the cavity 116 and the outer chamber 118 is filled or filling with liquid fluid. The pressure threshold and/or threshold amount can be based on the internal characteristics of the pressure valve 112, such as a spring or other component or structure in the valve 112 that can act as a set point.

In a similar manner, the output valve 112B can be oriented such that when the pressure of the fluid on the inside of the cavity 116 satisfies the pressure threshold of the output valve 112B (e.g., exceeds the pressure of the fluid outside the cavity 116 by a threshold amount), the output valve 112B can open allowing fluid to exit the cavity 116. This may occur, for example, when fluid in the inner chamber is heated by the tube 102. For example, as the fluid in the cavity 116 is heated, it can exert greater pressure on the output valve 112B. In some cases, the fluid in the cavity 116 can be heated to boiling or relatively close to boiling (e.g., within 5-10 degrees Fahrenheit of boiling). When the pressure satisfies the threshold pressure (e.g., differential pressure exceeds or satisfies the pressure threshold of the output valve 112B), the output valve 112B can open allowing fluid to exit the cavity 116. As the fluid exits, the pressure in the cavity 116 decreases. When the pressure in the cavity 116 no longer satisfies the pressure threshold of the output valve 112B, the valve 112B can close. The pressure threshold and/or threshold amount can be based on the internal characteristics of the pressure valve such as a spring or other component or structure in the valve 112 that can act as a set point.

Further, when the output valve 112B closes, if the pressure outside the cavity 116 (e.g., the pressure proximate the intake valve 112A) satisfies a pressure threshold (e.g., exceeds the pressure of the fluid inside the cavity 116 by a threshold amount), the intake valve 112A can open allowing fluid to enter the cavity 116. As fluid enters the cavity 116, the pressure differential will drop. When the pressure of the fluid outside the cavity 116 no longer satisfies the pressure threshold of the intake valve 112A, the intake valve 112A will close. The fluid in the cavity 116 can be heated and the process can repeat. As this process repeats, it can create a fluid pumping action—effectively pumping fluid from the outer chamber 118 into the cavity 116, heating it, and then pumping it back out to the outer chamber 118.

It will be understood that the system can include fewer or more chambers. For example, fluid may be allowed to move freely between the interior of the thermoplastic tube 104 and/or tube 102 and the exterior of the thermoplastic tube 104 and/or tube 102 as part of one chamber. As another example, the system can include any one or any combination of a chamber within the tube 102, a chamber between the tube 102 and the thermoplastic tube 104, a chamber between the thermoplastic tube 104 and the sleeve 110, and a chamber between the sleeve 110 and the thermoplastic receptacle 114. In some such cases, fluid in one chamber may be isolated from fluid in other chambers permanently or temporarily using valves, etc. In some such embodiments, valves, like valves 112 can be used to enable fluid to pass between different chambers.

As yet another embodiment, the tube 102 can be located within the inner chamber 116 (formed by the thermoplastic tube 104) such that fluid within the inner chamber 116 can freely move between the inside of tube 102 and the outside of tube 102. For example, there may be space between one end of the tube 102 and an upper portion (or top) of the thermoplastic tube 104 and between another end of the tube 102 and lower portion (or bottom) of the thermoplastic tube 104. In some such embodiments, the valves 112 can be coupled to the thermoplastic tube 104.

Similarly, the thermoplastic tube 104 and the sleeve 110 can be located within the outer chamber 118 (formed by the thermoplastic receptacle 114) such that fluid within the outer chamber 118 can freely move between the inside of the sleeve 110 and the outside of the sleeve 110. For example, there may be space between one end of the sleeve 110 and an upper portion (or top) of the thermoplastic receptacle 114 and between another end of the sleeve 110 and lower portion (or bottom) of the thermoplastic receptacle 114.

However, as mentioned, in certain embodiments, the system 100 can include additional chambers. For example, the tube 102 can create a separate chamber from the chamber formed by the high temperature thermoplastic tube 104 (e.g., with a seal or valve between the ends of the tube 102 and the thermoplastic tube 104) such that fluid inside the tube 102 cannot freely move to the outside of tube 102 (without a valve, etc.). Similarly, the sleeve 110 can create a separate chamber from the chamber formed by the thermoplastic receptacle 114 (e.g., with a seal or valve between the ends of the sleeve 110 and the thermoplastic receptacle 114) such that fluid inside the sleeve 110 cannot freely move to the outside of the sleeve 110 (without a valve, etc.)

The receptacle 114 can be made of thermoplastic, ceramic, glass, or other material that can withstand high temperatures without melting and/or that does not conduct electricity and/or heat in an efficient manner. The receptacle 114 can be shaped to house or store a fluid, such as, but not limited to water or other liquid. In addition, the receptacle 114 can enclose the tube 102, thermoplastic tube 104, induction coil 106, rolled tube 108, sleeve 110, and valves 112. In certain embodiments, the receptacle 114 can also enclose a controller that controls the current in the induction coil 106. In some embodiments, the controller is exterior to or remote from the receptacle 114.

The receptacle 114 can be filled with fluid that is to be heated. Fluid can enter the receptacle 114 via an inlet that connects to the intake valve 112A, the rolled tube 108, and/or is open to the receptacle 114. In the illustrated embodiment of FIG. 1B, fluid enters the receptacle by first going through the inlet of the rolled tube 108 and then outputting to the interior of the receptacle 114. Fluid can exit the receptacle 114 via an outlet. During use, cooler fluid can enter the receptacle 114 via the inlet and fluid that has been heated can exit the receptacle via the outlet. In the illustrated embodiment of FIG. 1B, the inlet is at the bottom of the receptacle 114 and the outlet is at the top of the receptacle 114. However, it will be understood that the inlet and outlet can be placed in a variety of locations. Further, multiple inlets and outlets can be used. Fluid in the receptacle 114 can be heated as described herein.

Various components of the system can be in direct contact with fluid to increase heating efficiency. For example, fluid, such as water may be located within the rolled tube 108, within the inner chamber 116, and/or within the outer chamber 118. As another example, the exterior of the sleeve 110 can be immersed or in contact with fluid. Fluid can also be located in the interior of the sleeve 110 and can be in contact with the exterior of the high temperature thermoplastic tube 104, the exterior of the rolled tube 108 and the exterior of the induction coil 106. In addition, fluid can be located in the interior of the rolled tube 108 and the interior of the tube 102. As the various components of the system 100 generate heat, the heat can be transferred to the fluid that is in contact with the respective component. In this way, the system 100 can increase the surface area of fluid being heated and increase the efficiency of energy transfer from electricity to heat. Further, in some cases, the fluid can be used to cool certain components of the system 100, such as the tube 102 and the induction coil 106. In certain embodiments, certain components may not be immersed in the fluid that is to be heated. For example, the induction coil 106 may not be immersed. In some such embodiments, the system 100 can use coil cooling or cooling lines to keep the induction coil 106 from overheating.

The system 100 can control the alternating current using an electronic controller electrically coupled to the induction coil 106. In certain embodiments, the electronic controller includes a processor and non-transitory computer-readable media with computer executable instructions that when executed cause the processor to control the alternating current provided to the induction coil 106. The electronic controller can also include a power converter, filtered DC bus, inverter, resonant circuit, power converter, temperature sensor, etc., as described herein at least with reference to FIG. 2, to provide load balancing and gate control. As shown in FIG. 1B, in some cases, an outlet, valve, or opening or other passageway can enable some fluid to exit the rolled tube 108 and enter the outer chamber 118 and/or the inner chamber 116.

The check valves 112 can enable fluid to enter the inner chamber 116 that is located between the two check valves 112. The electromagnetic field generated by the induction coil 106 can also generate heat in the tube 102 thereby heating the fluid within the inner chamber 116. As the fluid is heated within the inner chamber 116 the upper check valve 112 can be opened to allow the heated fluid to escape (and e.g., enter the outer chamber 118) and the lower check valve 112 can be opened to allow additional fluid to enter the inner chamber 116 (e.g., from the outer chamber 118). In this way, the tube 102 can heat fluid and create a fluid pumping action. The pumping action can increase the efficiency of heating fluid and decrease the likelihood of different temperatures of fluid within the outer chamber 118.

In certain embodiments, the opening of the upper check valve 112 and lower check valve 112 can be done automatically based on the temperature and/or pressure of the fluid within the tube 102. For example, as the fluid is heated it can increase pressure on the upper check valve 112. When the pressure overcomes a pressure threshold of the upper check valve 112, which may be based on the physical characteristics of the upper check valve 112, it can open and the heated fluid (or steam) can be released. The opening and release of the fluid via the upper check valve 112 can induce the lower check valve 112 to open, enabling fluid to enter the inner chamber 116.

The electromagnetic fields generated by the induction coil 106 can also generate heat in the sleeve 110, which can be immersed in fluid to provide additional fluid heating potential to fluid in the outer chamber 118.

The fluid heated by the rolled tube 108, tube 102, and/or the sleeve 110 can be combined. For example, with reference to FIG. 1B, the upper check valve 112 (when opened) can allow fluid from the inner chamber 116 to combine with fluid from the outer chamber 118. In addition, as illustrated in FIG. 1B, an inlet, valve, or opening near the output of the rolled tube 108 can allow fluid from the inner chamber 116 and/or outer chamber 118 to combine with fluid in the rolled tube 108. It will be understood that the heated fluid from the different chambers or tubes can be combined in a variety of manners.

With continued reference to FIG. 1A, in some embodiments, the system directs the field density of the induced magnetic pattern into a system of fluid coils 108, large area heat contact surface with sleeve 110 far exceeding the contact area of typical electrical Cal-Rods or heating elements, and a central suseptor interior of the fluid and induction coil 106, where fluid boils and is contained with respect to flow direction by one way check valves 112, creating fluid flow with the existing energy utilized for heating the fluid. The result is a circulating pump with few or no additional moving parts. This system can be used for maintaining temperature of tank fluid and eliminating thermoclines within the tank causing uneven fluid heating. Additionally, in some cases all the heating components can be submerged in a heated fluid flow, thereby convecting all the residual thermal energy into the fluid field from all the individual components (FIG. 1B). In certain cases, only the electronic controller is exterior to the tank flow.

Figure 2:
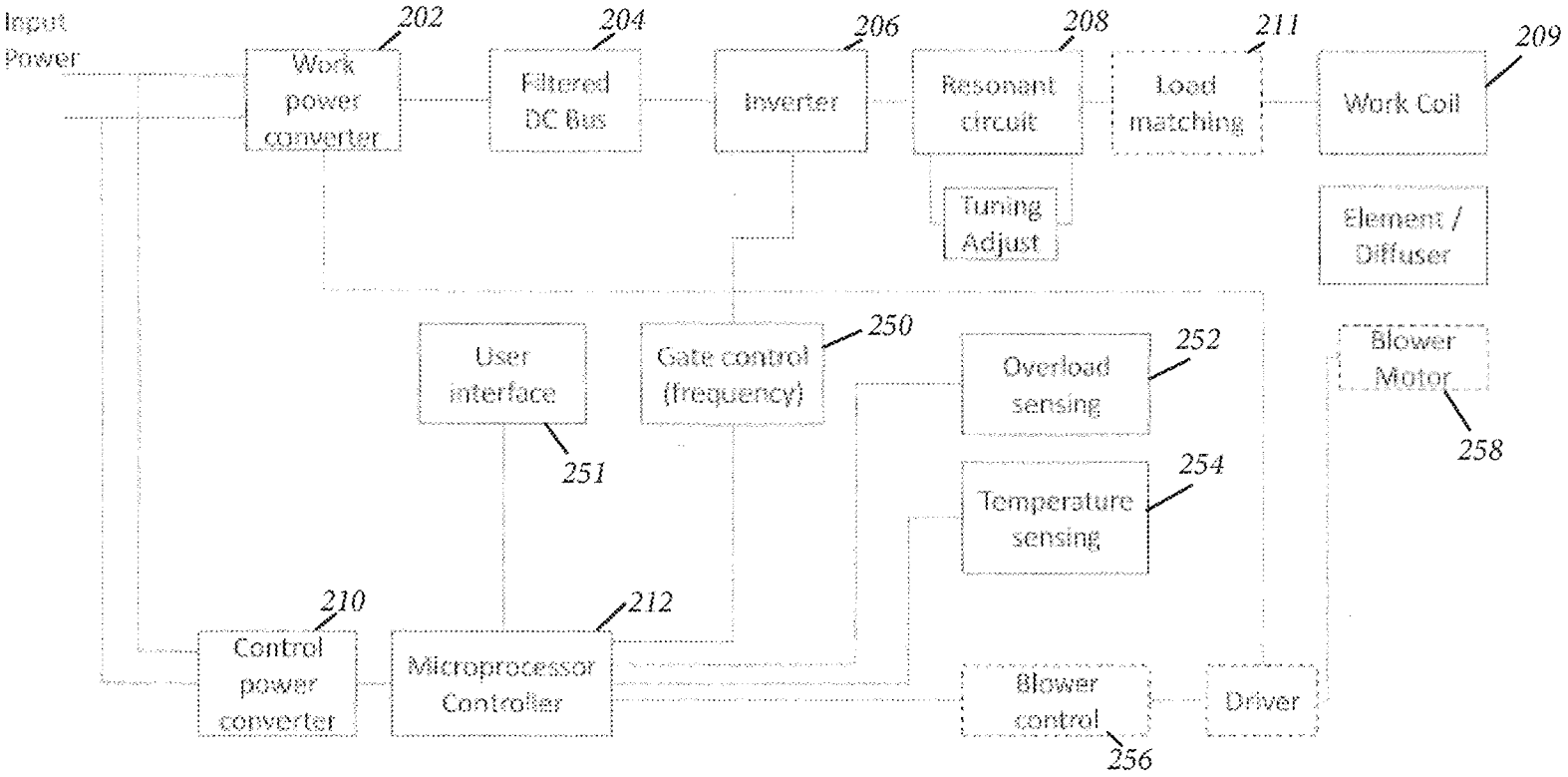
FIG. 2 is a diagram illustrating an embodiment of a controller that can be used as part of the heating system.

FIG. 2 is a diagram illustrating an embodiment of a controller that can be used as part of the heating system 100. The controller can include solid state components, such as, but not limited to, switches, digital readouts, thermocouples or other measurement and logic devices. In the illustrated embodiment, the controller includes a coil power converter 202, DC bus 204, inverter 206, resonant circuit and tuning adjust 208, control power converter 210 and microprocessor 212. The coil power converter 202, DC bus 204, inverter 206, resonant circuit and tuning adjust 208 can be used to control the coils 209 of the heat engine 12. In some embodiments, the components of the controller can be configured to provide load matching 211 for the coils 209

The microprocessor 212 can provide gate control 250 (and frequency control) to the inverter 206. The microprocessor 212 can also provide a user interface 251 to enable a user to control the heating system 100. The microprocessor can further provide overload sensing 252 and temperature sensing 254 functionality. For example, the microprocessor can monitor the electrical power being used by the system. If the power exceeds a safety threshold, the microprocessor 212 can deactivate the heat system 100. Similarly, the microprocessor can monitor the temperature at the substrates and/or target location. If the substrates become too hot or otherwise satisfy a temperature threshold, the microprocessor 212 can deactivate or reduce the power to the system. Similarly, if the temperature in the receptacle reaches a desired temperature or otherwise satisfies a temperature threshold, microprocessor 212 can deactivate or reduce the power to the system (e.g., to the induction coils 106). In some embodiments, the system can include a blower or fan to circulate the fluid. In some such embodiments, the microprocessor can provide blower control 256 to control the fan or other type of blower. In such embodiments, the controller can further include a driver for the blower motor 258.

The controller can be used to control power generating circuits that provide the RF energy to the induction coil and heat transfer system. The controller can take into consideration certain temperature ranges at the inlet and output stages, power application, and proportionate power settings to increase and/or maximize the efficiency of the system. For example, the controller can monitor the heat system, thermal transfer device, or any portion thereof (e.g., rolled tube 108, tube 102), etc. The controller can also include components for fans and fluid control devices within the entire unit and also to monitor safety and effective resource management of the complete assembly for its intended use.

In some embodiments, the controller can control the valves 112. For example, the controller can monitor a temperature sensor located in the cavity 116. When the temperature of the fluid in the cavity 116 satisfies a threshold temperature, the controller can open the output valve 112B to let the heated fluid out and then open the intake valve 112A to let the cooler fluid into the cavity 116. In some such embodiments, the valves 112 can be actuator or solenoid controlled.

As an RF modulated device, frequency generation, measurement and control can also be included in the control panel circuitry. However, in some embodiments, the system can remain at a fixed operational frequency fixed by dedicated resonant components. It will be understood that the controller can include fewer or more components. For example, in some embodiments, the inverter 206 can be omitted.

In certain embodiments, coil cooling lines and/or a coil cooling pump unit can also or alternatively be used for controlling induction coil 106 within specified limits. For example, a cooling line can be coupled to the coils 106 and be used to keep the coil 106 from overheating. In some embodiments, one or more heat sinks can be coupled to the coil 106 to keep the coil 106 from overheating.

In some cases, the controller can be used to track, store, and analyze the modulated frequency, voltage, current parameters, substrate material, substrate configuration, output temperature, and other system parameters to define and populate a database. The database can be used to define baseline information to permit a single component or group of system components to function in a multitude of ways for a multitude of applications.

Accordingly, certain embodiments can include a logic engine or computer system to evaluate and determine a proper magnetic induction parameter or set of parameters to control and/or anticipate system output requirements and system design outcomes based on one or more system inputs, system configurations, system components, and combinations thereof An embodiment employs a magnetic induction circuit capable of resolving and producing magnetic fields tailored for the configuration of the substrates (e.g., tube 102, rolled tube 108, sleeve 110) surface directly affected and induced by the surrounding induction coil 106. The coil orientation and configuration can be altered to produce different patterns of magnetic fields, polarity, or configured to meet the physical dimensions of the substrate configuration within its field.

Using this methodology, an evaluation can be made and the proper magnetic induction parameters can be controlled and anticipated to provide a specific design outcome. All methods described here in can be performed in any suitable safe order unless otherwise indicated and does not pose a limitation on the scope of the invention unless otherwise claimed. Moreover, any combination of the above-described elements in all possible variations thereof is encompassed by the invention unless otherwise indicated herein or otherwise clearly contradicted by context.

It should be apparent to those skilled in the art that many more modifications besides those already described are possible without departing from the inventive concepts herein. For instance, the induction coil 106 can be mounted internal or external to the rolled tube 108.

Figure 3:
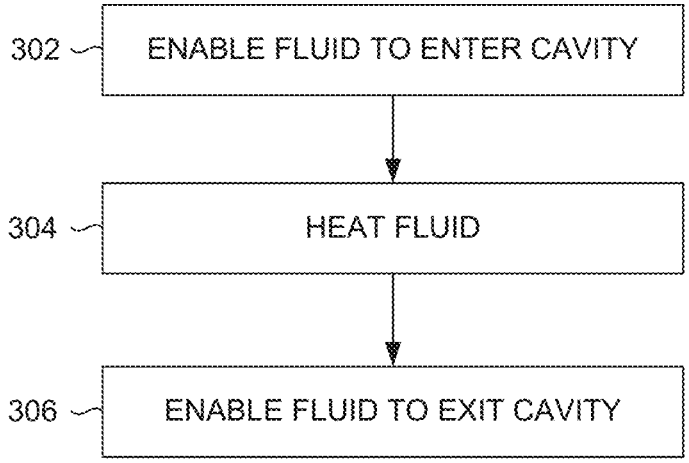
FIG. 3 is a flow diagram illustrating an embodiment of a routine for heating fluid using a magnetic induction system.

FIG. 3 is a flow diagram illustrating an embodiment of a routine for heating fluid using a magnetic induction system, such as heating system 100. The routine 300 can be implemented using any one or any combination of the components described herein relative to the heating system 100. For simplicity, however, reference will be made to the heating system 100 performing the various steps of the routine 300.

At block 302, the heating system 100 enables fluid to enter a cavity from a chamber. As described herein, the cavity 116 can be formed by the tube 102 and/or the valves 112. The chamber can be formed by the receptacle 114. As described herein, the valves 112 and/or open ends of the tube 102 (or sleeve 110) can enable the fluid to enter the cavity 116. In some cases, as described herein, the valves 112 can be pressure valves and open and close based on a differential pressure. In some such embodiments, the valves 112 can open when the fluid in the chamber satisfies a pressure threshold and/or when the pressure of the fluid in the chamber exceeds the pressure of the fluid in the cavity 116 by a threshold amount. The pressure threshold and/or threshold amount can be based on the internal characteristics of the pressure valve 112, such as a spring or other component or structure in the valve 112 that can act as a set point.

At block 304, the heating system 100 applies an alternating current to an induction coil 106 positioned within the receptacle 114. As described herein, by applying an alternating current to the induction coil 106, the heating system 100 can generate an electromagnetic field within at least a portion of the receptacle 114. The electromagnetic field causes ferrous materials within its radius to generate heat. As such, the tube 102 (or other substrate within the electromagnetic field) can generate heat. The heat generated in the tube 102 can be conducted to the fluid in the cavity 116. As the fluid heats, the pressure in the cavity 116 can increase.

At block 306, the heating system 100 enables the fluid to exit the cavity 116 and return to the chamber. As described herein, the heating system 100 can enable the fluid to exit the cavity 116 using the valves 112. Similar to the valve 112 that allows water to enter the cavity 116, a second valve 112 can enable the water to exit the cavity 116. The second valve 112 can also operate based on pressure or a pressure differential between the cavity 116 and the chamber. The second valve 112 can be oriented such that it opens when the pressure within the cavity 116 satisfies a pressure threshold (e.g., when it exceeds the pressure of the fluid in the chamber by a threshold amount). The pressure threshold and/or threshold amount can be based on the internal characteristics of the second valve 112, such as a spring or other component or structure in the second valve 112 that can act as a set point.

As the fluid escapes the cavity 116, the pressure in the cavity 116 can decrease. Once the pressure in the cavity 116 no longer satisfies the pressure threshold, the second valve 112 can close. Concurrently if/when the pressure in the chamber satisfies the pressure threshold associated with the first valve 112, then the first valve 112 can open and allow fluid to enter the cavity 116. As that fluid heats and the pressure goes up the process can be repeated. In this way, the tube 102 and valves 112 can form a fluid pumping action—effectively sucking water from the chamber of the receptacle into the cavity 116, heating it, and putting it back into the chamber.

It will be understood that fewer more or different steps can be included in the routine 300 and/or that the steps can be completed in a different order or concurrently. For example, the heating system 100 can concurrently enable fluid to leave the cavity 116 (e.g., via the second valve 112) and enable fluid to enter the cavity 116 (e.g., via the first valve 112). For example, in addition to heating the fluid in the cavity 116, the heating system 100 can heat fluid in a rolled tube 108 (that includes ferrous material) that is proximate the induction coil 106 (e.g., close enough to be within the electromagnetic field generated using the induction coil). The heating system 100 can further heat fluid in the chamber using a sleeve 110 that include ferrous material and that is proximate the induction coil 106 (e.g., close enough to be within the electromagnetic field generated using the induction coil).

What is claimed is:

1. A magnetic induction liquid heating system, the system comprising:

a receptacle configured to house a liquid;

an induction coil coupled to a thermoplastic tube located within the receptacle, wherein the induction coil is coupled to a controller, wherein the controller is configured to induce an electromagnetic field within a space using the induction coil;

a heating tube positioned within the receptacle, wherein the heating tube forms a cavity, wherein at least a portion of the heating tube is positioned within the space, and wherein the heating tube is configured to generate heat in response to the induced electromagnetic field;

a first valve coupled to a first end of the heating tube, wherein the first valve is configured to enable liquid to pass from a chamber into the cavity, wherein the chamber is formed at least in part by an interior of the receptacle;

a second valve coupled to a second end of the heating tube, wherein the second valve is configured to enable liquid to pass from the cavity to the chamber;

a rolled tube positioned within the chamber, wherein a first end of the rolled tube receives liquid and a second end of the rolled tube outputs the liquid to the chamber; and a sleeve positioned within the chamber and configured to encircle the heating tube, the induction coil, and the rolled tube.

2. The heating system of claim 1, wherein the first valve is configured to enable liquid to pass from the chamber into the cavity based on a pressure of liquid in the chamber satisfying a threshold pressure.

3. The heating system of claim 1, wherein heating tube is configured to heat liquid in the cavity, and wherein the second valve is configured to enable liquid to pass from the cavity to the chamber based on a pressure of liquid in the cavity satisfying a threshold pressure.

4. A magnetic induction fluid heating system, the system comprising:

a receptacle configured to house a fluid;

a heating substrate positioned within the receptacle, the heating substrate comprising a ferrous material, wherein a first heating cavity is formed at least in part by the heating substrate;

a first valve coupled to a first end of the heating substrate:

wherein the first valve is configured to enable fluid flow from the first heating cavity to a second heating cavity;

wherein the second heating cavity is formed at least in part by the receptacle;

an induction coil proximate the heating substrate; and a controller configured to provide an alternating current to the induction coil thereby generating an electromagnetic field, wherein the heating substrate is configured to heat fluid within the first heating cavity in response to the electromagnetic field.

5. The system of claim 4, wherein the induction coil encircles at least a portion of the heating substrate.

6. The system of claim 4, wherein the heating substrate encircles at least a portion of the induction coil.

7. The system of claim 4, wherein the first valve is a first pressure valve having a first pressure threshold, wherein the first valve enables fluid to flow from the first heating cavity to the second heating cavity based on fluid in the first heating cavity satisfying the first pressure threshold.

8. The system of claim 4, further comprising a second valve coupled to a second end of the heating substrate, wherein the second valve is configured to enable fluid to flow from the second heating cavity to the first heating cavity.

9. The system of claim 8, wherein the second valve is a second pressure valve having a second pressure threshold, wherein the second valve enables fluid to flow from the second heating cavity to the first heating cavity based on fluid in the second heating cavity satisfying the second pressure threshold.

10. The system of claim 9, further comprising a rolled tube wound in a helical fashion, wherein the rolled tube is positioned within the receptacle and encompasses at least a portion of the induction coil.

11. The system of claim 10, wherein the rolled tube comprises a ferrous material.

12. The system of claim 10, wherein the rolled tube comprises an inlet configured to receive fluid exterior to the receptacle and an outlet configured to provide fluid to the receptacle.

13. The system of claim 10, further comprising a sleeve, wherein the sleeve is positioned within the receptacle and encompasses at least a portion of the rolled tube.

14. The system of claim 13, wherein the sleeve comprises a ferrous material.

15. A method of heating fluid using magnetic induction, the method comprising:

enabling fluid to enter a cavity from a chamber, wherein the cavity is formed at least in part by a heating substrate positioned within a receptacle, and wherein the chamber is formed at least in part by the receptacle;

applying an alternating current to an induction coil positioned within the receptacle, wherein the induction coil encompasses at least a portion of the heating substrate, and wherein the alternating current induces the induction coil to generate an electromagnetic field, wherein the electromagnetic field induces the heating substrate to generate heat, wherein the heating substrate heats the fluid; and enabling the heated fluid to exit the cavity and enter the chamber.

16. The method of claim 15, wherein the fluid enters the cavity based on a pressure of the fluid satisfying a threshold pressure.

17. The method of claim 16, wherein the threshold pressure is based on a difference in pressure of the fluid and content of the cavity.

18. The method of claim 15, wherein the fluid exits the cavity based on a pressure of the fluid satisfying a threshold pressure.

19. The method of claim 18, wherein the threshold pressure is based on a difference in pressure of the heated fluid and content of the chamber.

* * * * *